United States Patent [19]

Agins

[11] 4,214,770

[45] Jul. 29, 1980

[54] SKI POLE WITH WIND AND SUN SHIELD

[76] Inventor: Bonnie G. Agins, 221 Oakcrest Rd., San Anselmo, Calif. 94960

[21] Appl. No.: 33,108

[22] Filed: Apr. 25, 1979

[51] Int. Cl.[2] ..... A63C 11/22

[52] U.S. Cl. ..... 280/819; 294/61; 135/16

[58] Field of Search ..... 294/61; 135/16, 19; 280/11.37 E, 11.37 J

[56] References Cited

U.S. PATENT DOCUMENTS

| | | | |
|---|---|---|---|
| 448,203 | 3/1891 | Brice | 135/19 |
| 3,866,934 | 2/1975 | Braun | 135/16 |
| 4,130,294 | 12/1978 | Walker | 280/11.37 E |

*Primary Examiner*—James B. Marbert
*Attorney, Agent, or Firm*—Melvin R. Stidham

[57] ABSTRACT

The disclosure is of a ski pole having a hollow handle with a wind and sun shield therein. A guideway is disposed in the handle coaxially therewith and a rod is slidable in the guideway. There are a number of radial ribs pivoted at the end of the rod with a sheet fastened over them to form an umbrella-type structure. Means are provided to move the guideway toward the open end of the handle, carrying the umbrella-like structure outward of the open end, in which position additional means are operative to pivot the ribs outward to extended position.

6 Claims, 8 Drawing Figures

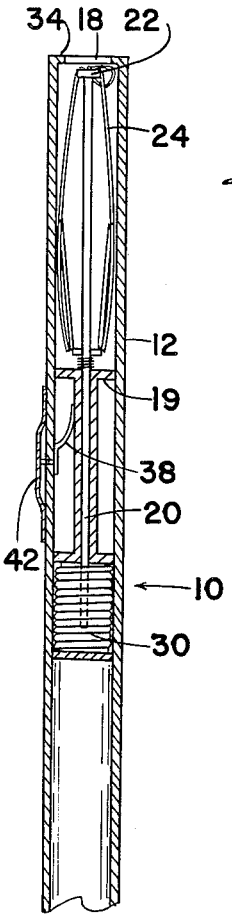
Fig. 2
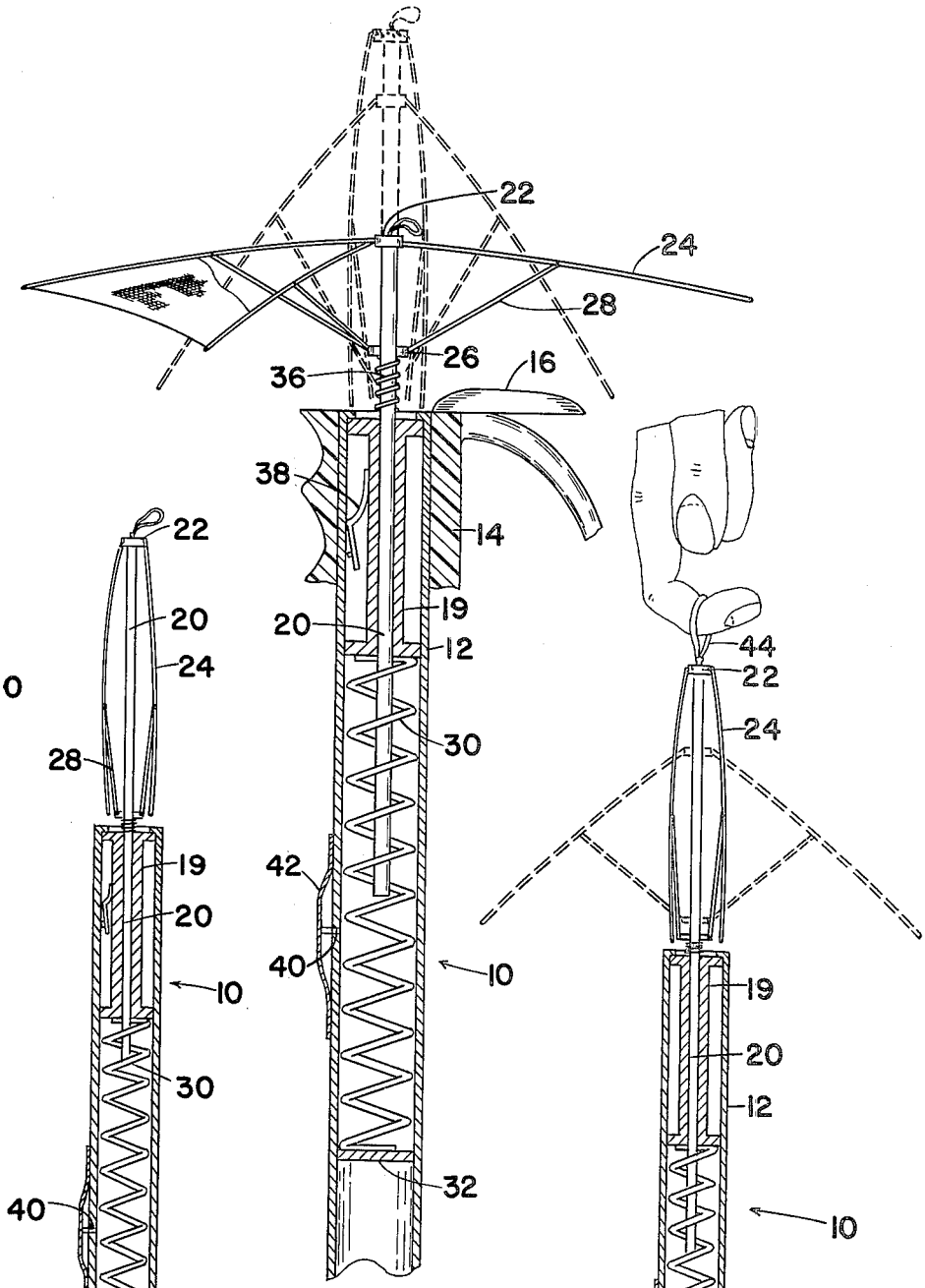
Fig. 1
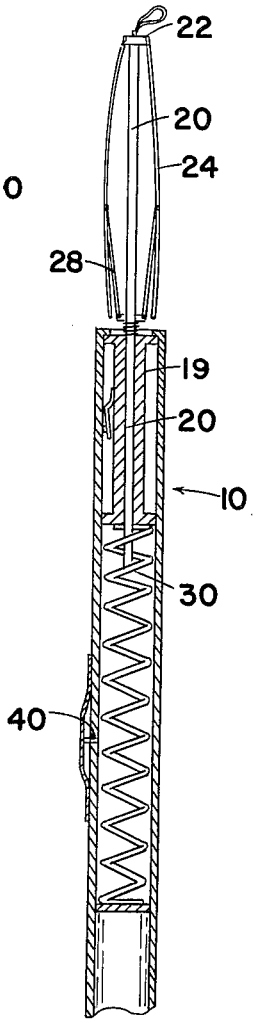
Fig. 3
Fig. 4

SKI POLE WITH WIND AND SUN SHIELD

BACKGROUND OF THE INVENTION

Skiers generally use ski lifts or chairs to carry them to the upper slopes for a ski run. Being seated in the lift above the slope, exposes the skier to the glare of the sun, direct and reflected, and to frigid winds, often at high velocity, causing extreme discomfort, particularly in the facial area. A wind shield of some sort could provide welcome relief but skiers, as a rule, do not wish to be encumbered on their subsequent ski run by carrying anything other than the usual ski poles.

OBJECTS OF THE INVENTION

It is an object of this invention to provide a wind and sun shield which is conveniently carried by a skier.

It is a further object of this invention to provide a wind and sun shield which may be used while riding a ski lift but which is conveniently carried on the downward ski run.

Other objects and advantages of this invention will become apparent from the description to follow, particularly when read in conjunction with the accompanying drawings.

SUMMARY OF THE INVENTION

In carrying out this invention, I provide a ski pole with a hollow handle and an open end in which is carried a guideway with a rod slidable therein. The rod has ribs and struts at the end thereof with a sheet over the ribs forming an umbrella-like structure. Means, such as a spring, may be operative when released to force the slideway with umbrella rod out through the end of the handle so that, when the ribs are free, additional means can be used to extend the ribs and open the wind shield for protection while riding on the ski lift. At the top of the slope the wind and sun shield is retracted back into the ski handle, and provides no interference with the normal ski activity.

BRIEF DESCRIPTION OF THE DRAWINGS

In the drawings:

FIGS. 1 to 5 are partial section views of a ski pole including an embodiment of this invention;

DESCRIPTION OF PREFERRED EMBODIMENTS

Figure 6:
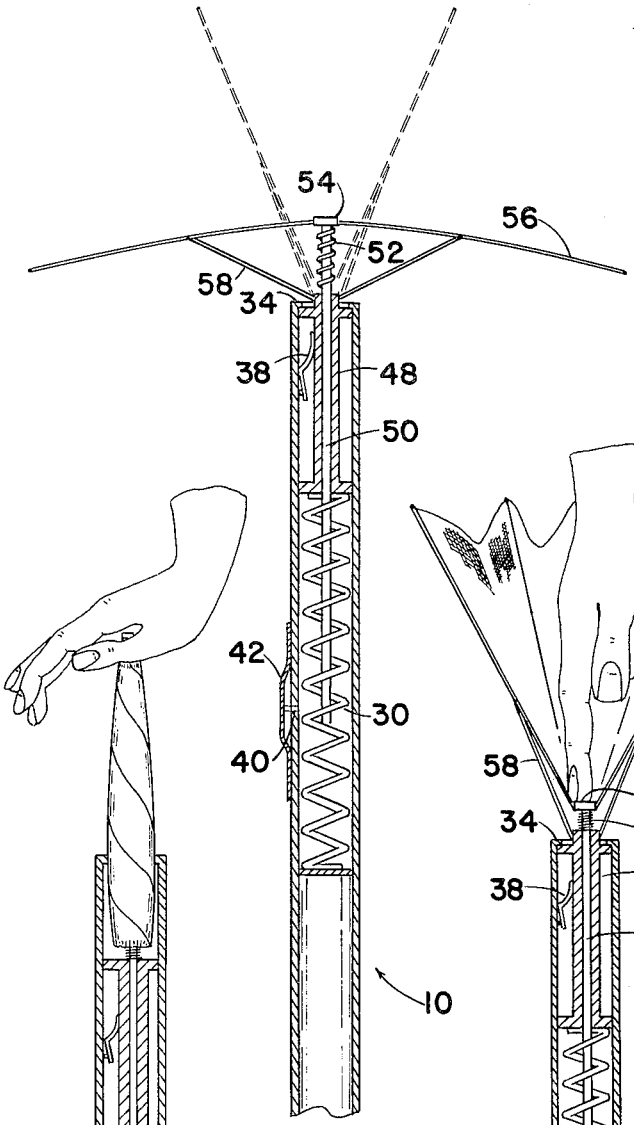
FIGS. 6 and 7 are partial section views of a ski pole including another embodiment of this invention.

The Embodiment of FIGS. 1 to 5

Referring now to FIGS. 1 to 5 with greater particularly, there is shown a ski pole 10 with a hollow handle portion 12 including a hand grip 14. A pivotable cap 16 may be turned aside when the ski pole 10 is not being used in the usual manner to uncover the open end 18 of the ski pole. Slidably carried within the hollow handle 12 is a guidewy 19 in which a rod 20 is, in turn, also slidably received. Pivoted to a ring 22 at the end of the rod is a series of ribs 24 and pivoted between the ribs and a ring 26, which is slidable on the rod 20, is a series of struts 28.

The guideway 19 is biased outward of the handle 12 by means of a spring 30 acting between the guideway 19 and a spring support 32. The forward thrust of the guideway is limited by stops 34 around the open end 18 of the handle so that the spring 30 when actuated forces the ribs to the position shown in FIG. 3 wherein they are just free of the open end 18 of the handle 12.

Figure 5:
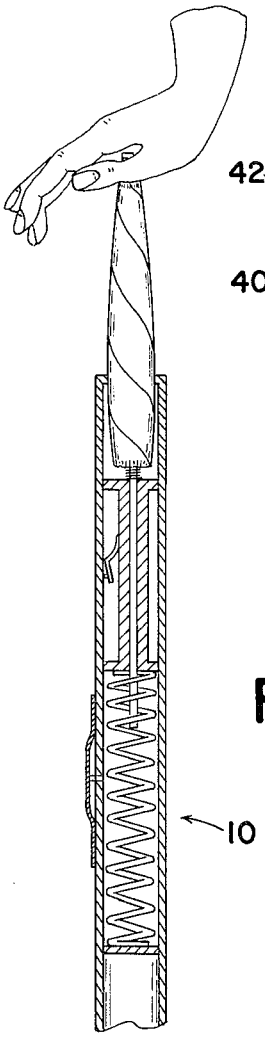

A second spring 36 acts between the guideway 19 and the slip ring 26 so that when the ribs are free to pivot the spring 36 forces the ring 26 upward to extend the ribs 24 to the position shown in full lines in FIGS. 1 and 5.

A spring catch 38 engages in an opening 40 in the wall of the hollow handle 12 when the guideway is in its retracted position shown in FIG. 2. A spring release 42, when depressed, forces the catch 38 out of the opening 40 and allows the spring to expand. In operation, with the wind shield in its retracted position shown in FIG. 2, the spring release 42 is depressed and the spring extends to move the guideway to the position shown in FIG. 3. At this point, the ribs are free to expand and, accordingly, the spring 36 forces the slideway 26 upward to extend the ribs outward to the position shown in FIG. 1. When the wind shield is to be returned to the handle 12 of the ski pole 10, a loop 44 on the end of the rod 20 is pulled to retract the ribs 24. Then the entire structure is forced into the handle 12, as shown in FIG. 5, against the spring 30, until the spring catch 38 is again engaged.

Figure 7:
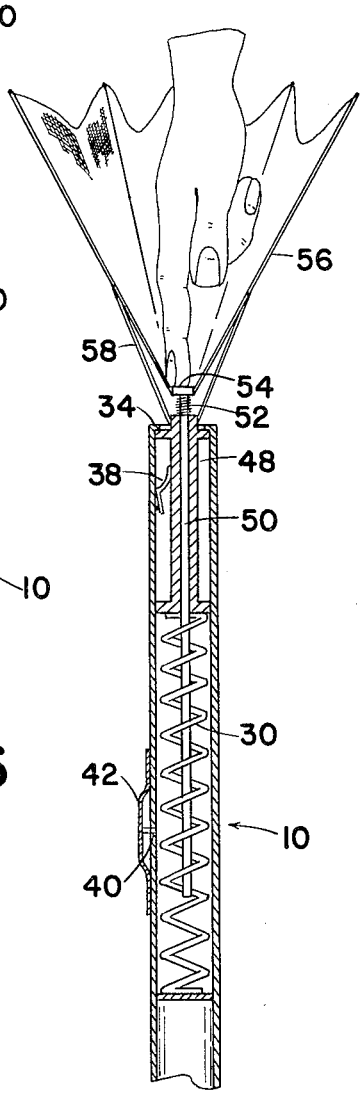

The Embodiment of FIGS. 6 and 7

Figure 8:
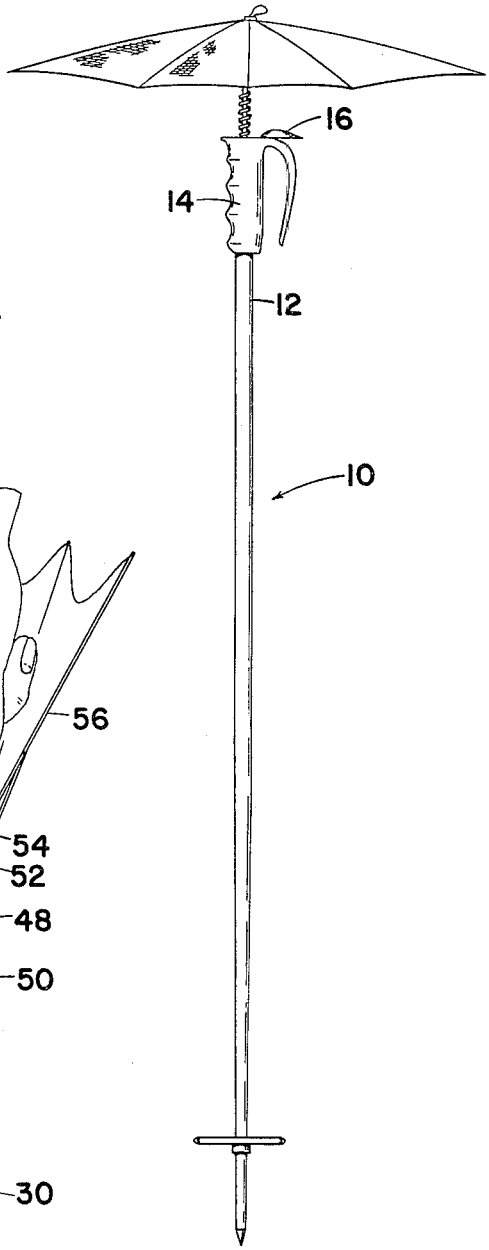
FIG. 8 is a plan view of the ski pole with windshield extended.

In this embodiment, the stem 20a is slidable in the guideway 19 as in the embodiment of FIGS. 1 to 5. However, in this embodiment, the spring 52 acts between the guideway 48 and the ring 54 on the end of the rod 50. The ribs 66 pivot upward to retract, and the struts are pivoted between the ribs 56 and guideway 48. Hence, when the spring 52 extends, it forces the ring 54 upwardly and, therefore, pivots the ribs downwardly. As in the first embodiment, when the spring release 42 is depressed it disengages the spring catch 38 allowing the spring 30 to force the guideway upwardly until engages the stops 34. At this position, the ribs 56 are free to pivot outward and, therefore, the spring 52 forces the ring 54 upward to pivot the ribs down to the fully open position shown in FIGS. 7. When the wind shield is to be retracted, one need merely push against the ring 54 as shown in FIG. 8 and then push the entire assembly down until the spring catch 38 engages in the opening 40, locking it in place.

While this invention has been described in conjunction with preferred embodiments thereof, it is obvious that modifications and changes therein may be made by those skilled in the art without departing from the spirit and scope of this invention, as defined by the claims appended hereto.

Having described my invention, I claim:

1. In a ski pole having a hollow handle, a wind and sun shield comprising;

an open end on said handle;

a guideway in said handle disposed along the axis thereof;

a rod slidable in said guideway;

a plurality of radial ribs pivoted at the end of said rod; and a sheet fastened over said ribs; to form an umbrella type structure; means for moving said rod axially to an extended position protruding from said panel;

said ribs being free to pivot between a fully open radial position and a fully closed position along the axis of said rod when said rod is in said extended position;

said ribs and sheet being receivable in the open end of said handle when in said fully closed position.

2. The wind and sun shield defined by claim 1 wherein:

said guideway is slidable in said handle; and including means for biasing said guideway and rod toward the open end thereof to carry said ribs outward thereof.

3. The wind and sun shield defined by claim 2 including:

a ring slidable on said rod;

a plurality of links connected between said ring and said ribs so that movement of said ring is one direction along said rod extends said ribs toward full open position; and spring means biasing said ring is said one direction.

4. The wind and sun shield defined by claim 1 wherein:

said guideway is slidable in said handle; and including spring means for biasing said guideway and rod toward the open end of said handle;

releasable holding means for securing said guideway in retracted position within said handle; and trigger means on said handle for releasing said holding of means.

5. The wind and sun shield defined by claim 4 wherein said holding means comprises:

a spring detent on said guideway; and a hole through the wall of said handle engageable by said detent;

said trigger means being disposed on the outside of said handle and being operative to push said detent from said hole.

6. The wind and sun shield defined by claim 1 including:

a closure cap movable to cover and uncover said open end.

* * * * *